US006338298B2

(12) United States Patent
Schneider et al.

(10) Patent No.: US 6,338,298 B2
(45) Date of Patent: Jan. 15, 2002

(54) ROTARY PRINTING MACHINE WITH BLANKET CYLINDERS AND PLATE OR FORM CYLINDERS INTEGRATED IN PAIRS IN CYLINDER GROUPS

(75) Inventors: Felix Schneider, Langenthal; Andreas Miescher, Ittigen; Andreas Zahnd, Zollikofen; Dieter Koch, Oberrohrdorf, all of (CH)

(73) Assignee: Maschinenfabrik Wifag (CH)

( * ) Notice: Subject to any disclaimer, the term of this patent is extended or adjusted under 35 U.S.C. 154(b) by 0 days.

(21) Appl. No.: 09/767,042

(22) Filed: Jan. 22, 2001

Related U.S. Application Data

(63) Continuation of application No. 09/309,239, filed on May 10, 1999, now abandoned, which is a continuation of application No. 08/967,750, filed on Nov. 10, 1997, now abandoned, which is a continuation of application No. 08/814,942, filed on Mar. 10, 1997, now abandoned, which is a continuation of application No. 08/365,231, filed on Dec. 28, 1994, now abandoned.

(51) Int. Cl.[7] ..... B41F 5/16

(52) U.S. Cl. ..... 101/179; 101/220

(58) Field of Search ..... 101/177, 216, 101/218, 219, 220, 221, 222, 178, 179, 181, 229, 230, 231, 248

(56) References Cited

U.S. PATENT DOCUMENTS

| | | | | | |
|---|---|---|---|---|---|
| 1,587,772 | A | * | 6/1926 | Granger | 101/220 |
| 1,698,544 | A | * | 9/1929 | Hicks | 101/179 |
| 1,920,616 | A | * | 8/1933 | Wood | 101/220 |
| 1,924,625 | A | * | 8/1933 | Roesen | 101/220 |
| 2,027,850 | A | * | 1/1936 | Wood | 101/220 |
| 2,053,958 | A | * | 9/1936 | Isbell | 101/178 |
| 2,053,979 | A | * | 9/1936 | Tornberg | 101/178 |
| 3,264,984 | A | * | 8/1966 | Smith, Jr. | 101/178 |
| 3,661,079 | A | * | 5/1972 | Stapleford | 101/179 |
| 3,848,320 | A | * | 11/1974 | Davidson, Jr. | 101/177 |
| 4,238,999 | A | * | 12/1980 | Giani et al. | 101/221 |
| 4,696,229 | A | * | 9/1987 | Bezler et al. | 101/220 |
| 5,284,090 | A | * | 2/1994 | Okamura et al. | 101/179 |

* cited by examiner

*Primary Examiner*—Eugene Eickholt
(74) *Attorney, Agent, or Firm*—McGlew and Tuttle, P.C.

(57) ABSTRACT

A rotary printing machine has blanket cylinders and plate cylinders, which are integrated in pairs into cylinder groups by a mechanical coupling for their joint drive. Such a cylinder group is driven by a separate drive motor.

22 Claims, 9 Drawing Sheets

ROTARY PRINTING MACHINE WITH BLANKET CYLINDERS AND PLATE OR FORM CYLINDERS INTEGRATED IN PAIRS IN CYLINDER GROUPS

RELATED U.S. APPLICATION DATA

The present application is a continuation of U.S. Ser. No. 09/309,239 filed May 10, 1999, and now abandoned which is a continuation of U.S. Ser. No. 08/967,750 filed Nov. 10, 1997 and now abandoned, which is a continuation of U.S. Ser. No. 08/814,942 filed Mar. 10, 1997 and now abandoned, which is a continuation of U.S. Ser. No. 08/365,231 filed Dec. 28, 1994 and now abandoned. This present application also claims priority from German Application DE 43 44 896.8 filed Dec. 29, 1993 and DE 44 05 658.3 filed Feb. 22, 1994. The entire disclosure of the above mentioned prior applications are considered to be part of the disclosure of the accompanying application and are hereby incorporated by reference therein.

FIELD OF THE INVENTION

The present invention pertains to the integration of cylinders of a rotary printing machine into individual cylinder groups.

BACKGROUND OF THE INVENTION

Prior-art rotary printing machines are driven by a main drive via a mechanical longitudinal shaft, also called a vertical shaft. One disadvantage of these printing machines is the mechanical effort that needs to be taken to compensate the torsion of the longitudinal shaft occurring during operation. As a result, it is necessary to mechanically adjust the circumferential register of print positions of the printing machine during operation.

Attempts have also been made to replace the mechanical longitudinal shaft between the individual printing units with an electrical longitudinal shaft. Thus, each printing unit receives a separate electrical drive. In addition to the high mechanical expense that continues to be necessary because of the complex nature of the individual printing units with a plurality of print positions, there is in this case a high expense for control technique, because synchronous operation of the individually driven printing units with one another must be guaranteed as well.

To avoid the above-mentioned problems, DE 41,38,479 A1 proposes that the cylinders of the printing machine be driven by one electric motor each.

DE 42,14,394 A1 discloses a process control system for such a printing machine with individually driven cylinders. The individual drives of the cylinders and their drive regulators can be arbitrarily integrated into print position groups. The print position groups are associated with folders, from which they obtain their position reference. The process control system proposed consists essentially of a high-speed BUS system for the individual drives and the drive regulators of a print position group and of a higher process control system for managing the print position groups.

Even though the design of the individually driven cylinders pursued in these two documents ensures a high level of flexibility in use, it also requires a very great number of drive motors at the same time, and, as is shown by DE 42,14,394 A1, a very high expense for regulating this great number of individual drives. Moreover, a great variety of motors must be used. If only a few motor sizes were used, it would otherwise frequently be necessary to use oversized motors for different applications. Both drive up the price of such a printing machine.

SUMMARY AND OBJECTS OF THE INVENTION

In contrast to the state of the art, the object of the present invention is to provide a rotary printing machine that can be used in a highly flexible manner and which is yet economical.

According to the present invention, blanket cylinders and plate cylinders of a rotary printing machine form in pairs a cylinder group, in which one blanket cylinder and one plate cylinder are mechanically coupled with one another and are driven together by a separate drive motor per cylinder group.

The number of the necessary drive motors is considerably reduced due to this group integration of the two cylinders and due to their being provided with a single drive for at least one cylinder pair; the number of the necessary drive motors is reduced by at least half compared with the individual drive designs. The mechanical coupling of these two cylinders, which are associated with one another in terms of printing technique, which is preferably a gear coupling with spur-toothed or helical gears, offers considerable advantages in terms of price over the design of the individually driven cylinders. No substantial concessions are to be made in terms of the flexibility of use compared with the individual drive design. Thus, both the circumferential register adjustment and the lateral register adjustment of each blanket cylinder can be performed individually and, if necessary, coordinated with each additional blanket cylinder. Technically and economically optimal print positions can be formed in a rotary printing machine due to the cylinder groups according to the present invention with separate drive motors. The print positions are defined in this connection as the cylinder pairs between which a web of paper to be printed on passes through and is printed on one side or on both sides. Consequently, one cylinder group and a corresponding counterpressure cylinder, which may, but does not have to, belong to the cylinder group, belong to a print position formed according to the present invention. However, the print positions of the printing machine are mechanically independent in terms of the drive technique in both cases, i.e., the print positions of the printing machine are electrically coupled with one another.

The blanket cylinder is preferably driven in the cylinder groups according to the present invention, and the blanket cylinder in turn drives the plate cylinder of the same cylinder group via the mechanical coupling. However, it is also possible to drive the plate cylinder shaft in another embodiment of the present invention, so that the blanket cylinder is driven only via the mechanical drive from the plate cylinder. While the drive of the plate cylinder advantageously requires a small effort for engaging and disengaging the blanket cylinder, the blanket cylinder is, on the other hand, decisive for the positional accuracy and the circumferential register adjustment. The first solution offers the advantage that the cylinder, which ultimately comes directly into contact with a web of paper to be printed on, does not need to be driven via a transmission member that may possibly have a clearance.

It is advantageous to always allow three cylinder groups to work on one print position. One cylinder group is arranged on one printed side, and two cylinder groups are arranged on the opposite printed side of a web of paper passing through between them. The blanket cylinder of the cylinder group arranged on one printed side of the web of paper preferably forms the counterpressure cylinder for the other two blanket cylinders of the cylinder groups arranged on the opposite printed side of the web of paper, and the latter cylinder groups are advantageously both driven alternatingly. This configuration offers the highest flexibility of use for a blanket/blanket production, because the two blanket cylinders that can be used alternatingly during ongoing production can be configured for changing over the print. This is performed by changing the plate of a plate cylinder associated with the non-engaged blanket cylinder. Each cylinder group can be mounted in an individual stand. The two cylinder groups located horizontally opposite one printed side of the web of paper are preferably integrated into a cylinder unit mounted in a stand.

According to the present invention, a cylinder group can be expanded by one counterpressure cylinder for the blanket cylinder. This third cylinder of the cylinder group thus formed is mechanically coupled with the blanket cylinder, preferably by an additional gear coupling. Such a cylinder group already represents a print position, between the blanket cylinder and counterpressure cylinder of which the web of paper to be printed on is passed through. The counterpressure cylinder may be a steel cylinder or another blanket cylinder for two-sided printing. Such a counterpressure cylinder may also especially be a central cylinder of a cylinder unit with, e.g., nine or ten cylinders. In an alternative, equally preferred embodiment of the present invention, such a central cylinder is driven by a separate drive motor. This type of integration guarantees the highest flexibility of use for a cylinder unit. Thus, each of the cylinder groups associated with the central cylinder can be reversed in this case individually and independently from the other cylinder groups, which is necessary, e.g., for alternate printing or for flying plate change.

The individual cylinder group is driven from a drive motor by means of a toothed belt. Such a toothed belt has a high elasticity compared with the solution proposed in DE 41,38,479 A1, according to which the rotor of the electric motor is mounted on the drive shaft of the driven cylinder. However, as will be explained later, the high damping of the mechanical system consisting of a drive motor and the driven cylinders is of great value for the control design of the drive of a cylinder group. However, the present invention also permits, in principle, direct drive, which may even be advantageous in the case of small cylinders. Compared with a gear drive between the drive motor and the driven cylinder of a cylinder group, which may also be used, a toothed belt offers the advantage of a clearance-free operation and of a not absolutely fixed transmission ratio.

In contrast, gears are provided for the mechanical coupling between the cylinders within one cylinder group, even though other transmission members are also conceivable. The mutually meshing gears may be spur gears or helical gears. In the case of spur gears, the blanket cylinder is longitudinally displaced for lateral register adjustment, while its driving and/or driven gears remain stationary according to the present invention. Otherwise, a circumferential register adjustment would also be necessary along with the lateral register adjustment. When spur gears are used, the blanket cylinder is simply displaced longitudinally together with its stationarily arranged gear or gears.

The inking roller or inking rollers of an inking system, which is/are associated with one cylinder group, can be mechanically coupled with that cylinder group according to the present invention, so that the inking roller or inking rollers is/are also driven from the drive motor of that cylinder group. The expense in terms of control (also referred to herein as control technique) can be kept low due to this solution. On the other hand, the mechanical coupling of the inking system according to the modular system pursued by the present invention is not quite so ideal as the more highly preferred individual drive for the roller or rollers of the inking system. Thus, each inking system has a separate drive motor for its inking rollers. Such a drive motor also preferably drives the inking roller or, in the case of a plurality of inking rollers, the inking roller located closest to the plate cylinder of the corresponding cylinder group via a clearance-free toothed belt with high damping and, if desired, via a reduction gear. The circumferential velocity of this inking roller is advantageously adjustable, especially with a negative slip in relation to the plate cylinder, so that the circumferential velocity of the inking roller is somewhat lower than that of the corresponding plate cylinder.

The positions of at least the drive motors of the cylinder groups of one cylinder unit operating on the same printed side of a web of paper are advantageously controlled. A so-called ideal position control, i.e., a delay-free position control with contouring error correction is preferred. However, this expensive type of position control, which is desirable for technical reasons, can be definitely dispensed with. A simple position control also represents a preferred, especially inexpensive embodiment of the present invention.

The position and/or the speed of rotation of the cylinder of a cylinder group or of a roller of an inking system to be controlled are controlled according to the present invention by means of a regulator for the drive motor by the variance comparison of the output signals of a set value transducer and of an actual value transducer, wherein the actual value transducer determines the position and/or the speed of rotation of the cylinder or roller. In contrast to the prior-art controls in rotary printing machines, a load transducer is thus used for control. In contrast, a mechanical transducer on the motor side has hitherto been used in the construction of printing machines to determine the motor speed or the angular position of the rotor of the motor for the variance comparison of the motor control. The dynamic limits are rapidly reached with this prior-art control in the case of high mass inertia ratios of the load to the motor. If the control becomes unstable, especially the motor begins to vibrate, while the load remains relatively still.

Difference correction means, control cascades, and active filters are used in control technique for so-called two-mass oscillators, but they require a high expense for control technique. It was surprisingly found to be fully sufficient for the above-described load/motor systems, i.e., the individually driven cylinder groups, to lead the control essentially by means of an actual value, which was determined by an actual value transducer arranged on the load, namely, on one of the cylinders of a cylinder group. This actual value-distance-angular position and/or speed of rotation of the corresponding cylinder is already sufficient alone to achieve high dynamics and control performance.

By obtaining the actual value to be controlled according to the present invention from the load, what must operate accurately, namely, the load, rather than the motor, is measured. The mechanical equivalent system consisting of the drive motor, a coupling and the load can be considered to be a low-pass filter. The low-pass filter of the motor-coupling-load-distance system is used in this type of control to filter impacts and vibrations, which are generated in the control system. Such impacts and vibrations are thus fed back into the regulator to a reduced extent. The risk of a build-up is reduced as a result. The dynamics of the control and consequently also the control performance can be substantially increased as a result compared with the prior-art control described, with identical coupling.

The actual value transducer, which has migrated, symbolically speaking, from the motor side to the load side, forms the principal controlled variable for the regulator of the motor, i.e., the motor is led from the load side by its actual value. According to an especially preferred embodiment of the present invention, no mechanical actual value transducer is needed for determining the position or the speed of rotation of the motor within the framework of the control of the motor. An actual value determination that may optionally be integrated within the motor can advantageously be used for exclusive drive monitoring, if desired, for switching off the motor.

The actual value transducer for the control is arranged, according to the present invention, at the torque-free shaft end of the driven cylinder of a cylinder group or of the driven roller of an inking system.

Asynchronous electric motors are used especially advantageously as the drive motors. An asynchronous motor has hitherto been used only when a small load was to be driven by means of a large motor. The use of asynchronous motors has been known for this case, in which a drive motor drives a cylinder group or even the rollers of an inking system, in which the mass inertia ratio of the load driven to the drive motor is relatively high. Asynchronous motors are particularly suitable for the purpose of control according to the present invention with a load transducer instead of a motor transducer. Asynchronous motors have a higher field rigidity than the d.c. motors used to date for these applications, so that their use improves the dynamics and the control performance of the system to be controlled. However, the use of other types of motors, e.g., d.c. motors, is not excluded, in principle.

The stability of the control is additionally improved by the preferred use of a clearance-free toothed belt with high damping as a coupling means between the motor and the load.

The drive motor may even be left out of consideration in the two-mass oscillator in question. The load, acting as a low-pass filter, is insensitive to the vibrations of the motor, which is much smaller compared with it. On the other hand, the reactions from the load to the drive motor can be ignored.

A maximum of flexibility is achieved with the design of integrating blanket cylinders and plate cylinders in pairs into cylinder groups, and, if desired, along with another counterpressure cylinder, while the price of a printing machine thus organized can be considerably reduced compared with a printing machine with individually driven cylinders. Drive motors of only two or at most three output classes are needed for a printing machine composed of such cylinder groups, while separate motors for cylinders with a great variety of different lengths and diameters are basically required in the case of directly and individually driven cylinders. The mass inertia ratios of the load to the motor, which may possibly vary within a wide range, can be absorbed and adjusted to one another by means of the toothed belt drive used according to the present invention. The reduction in the number of drive motors, together with the advantage that motors of only a few output classes must be provided, already offers considerable advantages in terms of price. This advantage is further enhanced by the use of the simple control according to the present invention, which is also flexibly adaptable to varying mass inertia ratios. The advantages achieved with the present invention become increasingly significant with increasing size of the printing machines, i.e., with increasing number of printing units and print positions per machine. The present invention is used especially in the construction of rotary offset printing machines, but it is not limited to them.

Preferred exemplary embodiments of the present invention will be explained below on the basis of the figures. Additional features and advantages of the present will be disclosed.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION OF THE PREFERRED EMBODIMENTS

Figure 1:
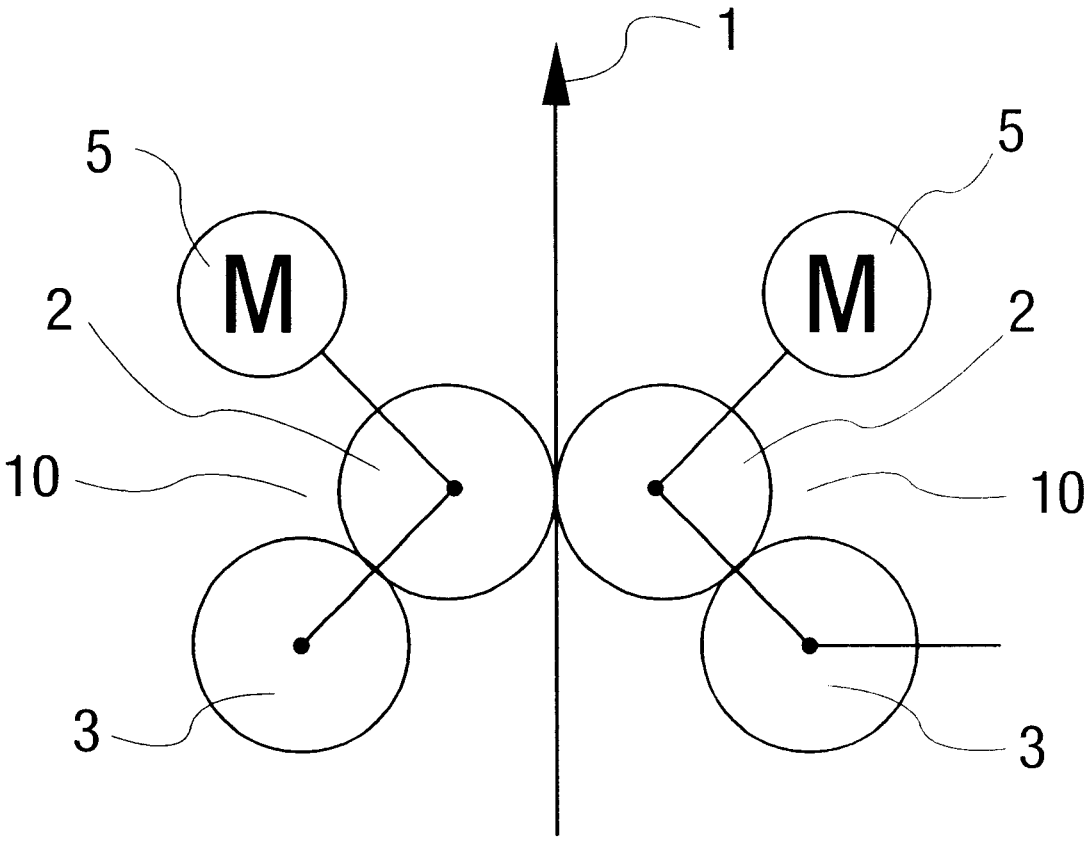
FIG. 1 is a schematic view showing a print position with two cylinder groups according to the invention.

In a print position shown in FIG. 1, a web of paper 1 to be printed on is passed through between the two blanket cylinders 2 of two cylinder groups 10 located opposite each other. The two cylinder groups 10 are formed by the blanket cylinder 2 and an associated plate cylinder 3 each, which are mechanically coupled to one another for the common drive. The mechanical coupling is schematically indicated by a connection line between the centers of the two cylinders 2 and 3. In the exemplary embodiment according to FIG. 1, the blanket cylinders 2 of each cylinder group 10 are driven by a three-phase motor 5. The configuration corresponding to FIG. 1, in which only one blanket cylinder 2 and one plate cylinder 3 are integrated into a cylinder group 10 by a mechanical coupling, is characterized by its simple design and the highest possible degree of configuration freedom in forming print positions and groups of print positions.

Figure 2A:
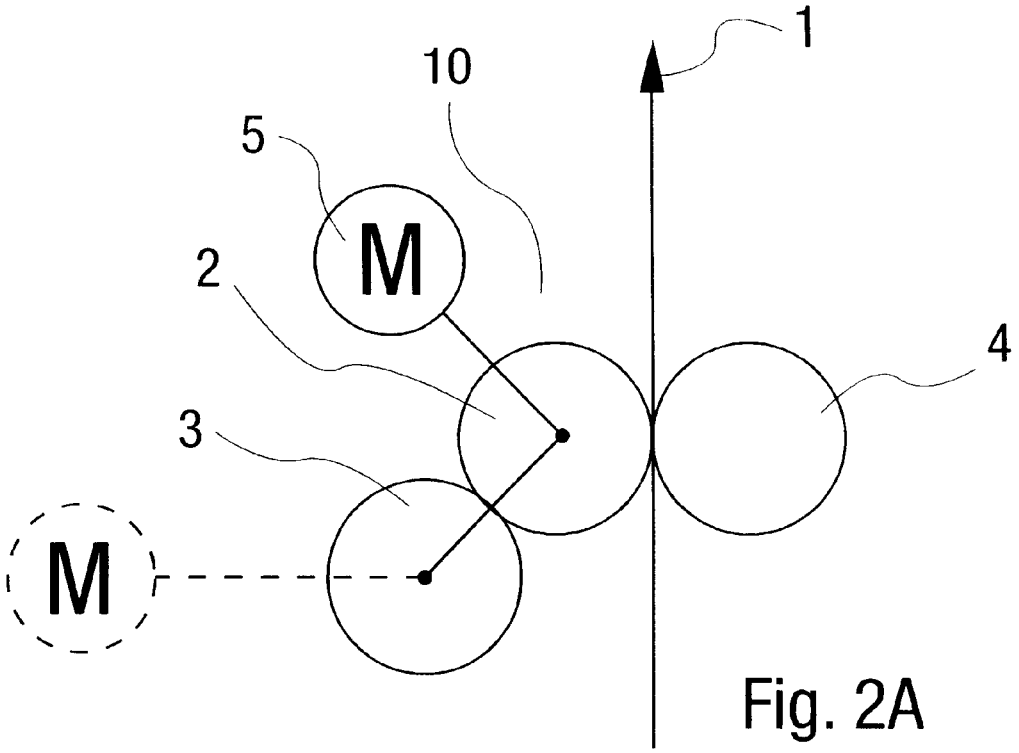
FIGS. 2A and 2B are a schematic views showing a print position with one cylinder group according to the invention.
Figure 2B:
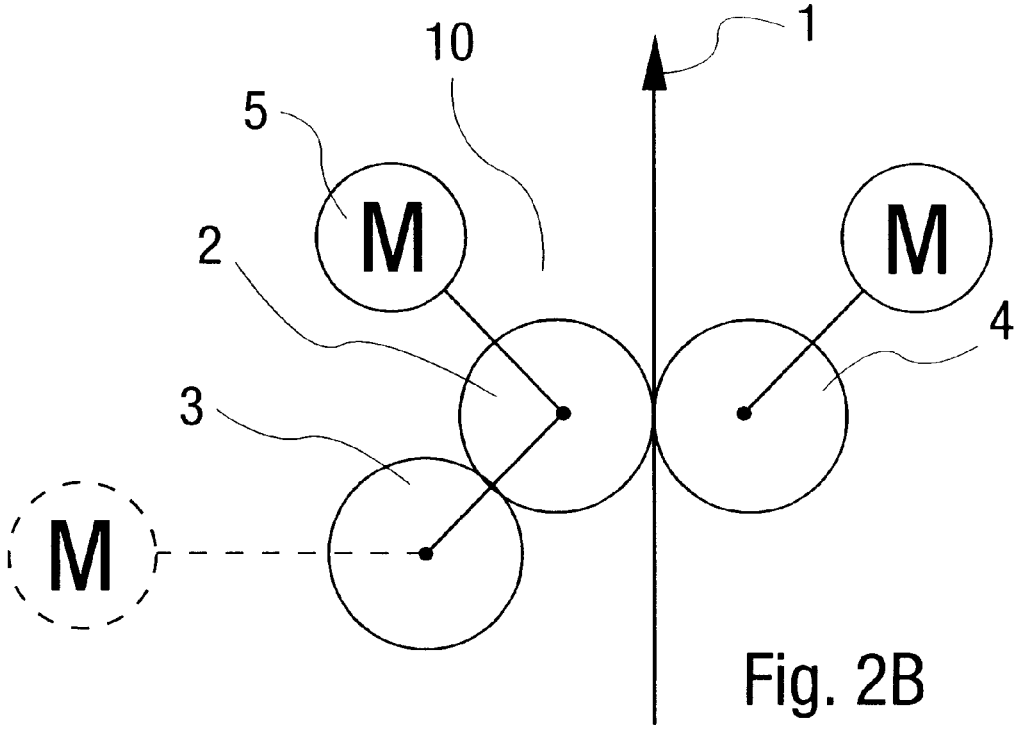

FIGS. 2A, 2B show a variant for forming a print position, in which a counterpressure cylinder 4 for the blanket cylinder 2 is mechanically coupled with that blanket cylinder 2. In this exemplary embodiment, the cylinder group 10 consists of the blanket cylinder 2, its counterpressure cylinder 4 and the plate cylinder 3 and its mechanical coupling, so that the print position is formed by a single cylinder group 10. In contrast to FIG. 1, the plate cylinder 3 associated with the blanket cylinder 2, rather than the blanket cylinder 2 is driven by a three-phase motor 5 in the exemplary embodiment according to FIGS. 2A, 2B. The advantage of this variant for integrating cylinders into a cylinder group is its constant delivery behavior because of the mechanical coupling of the blanket cylinder 2 with its counterpressure cylinder 4, and that the cylinders 2 and 4 do not mutually directly affect each other because of this mechanical coupling. The counterpressure cylinder 4 may be a second blanket cylinder or a steel cylinder, e.g., a central cylinder of a 9-cylinder or 10-cylinder unit.

The association of the motors 5 with the blanket cylinders 2 or the plate cylinders 3 can be reversed, in principle, in both exemplary embodiments. Driving the plate cylinder 3 offers the advantage that the cylinder group 10 can be reversed more easily, while in the other case, in which the blanket cylinder 2 is driven, the cylinder directly printing on the web of paper 1 is driven, and driving free from transmission members, e.g., gears, which may have a clearance, is possible as a result.

Figure 3:
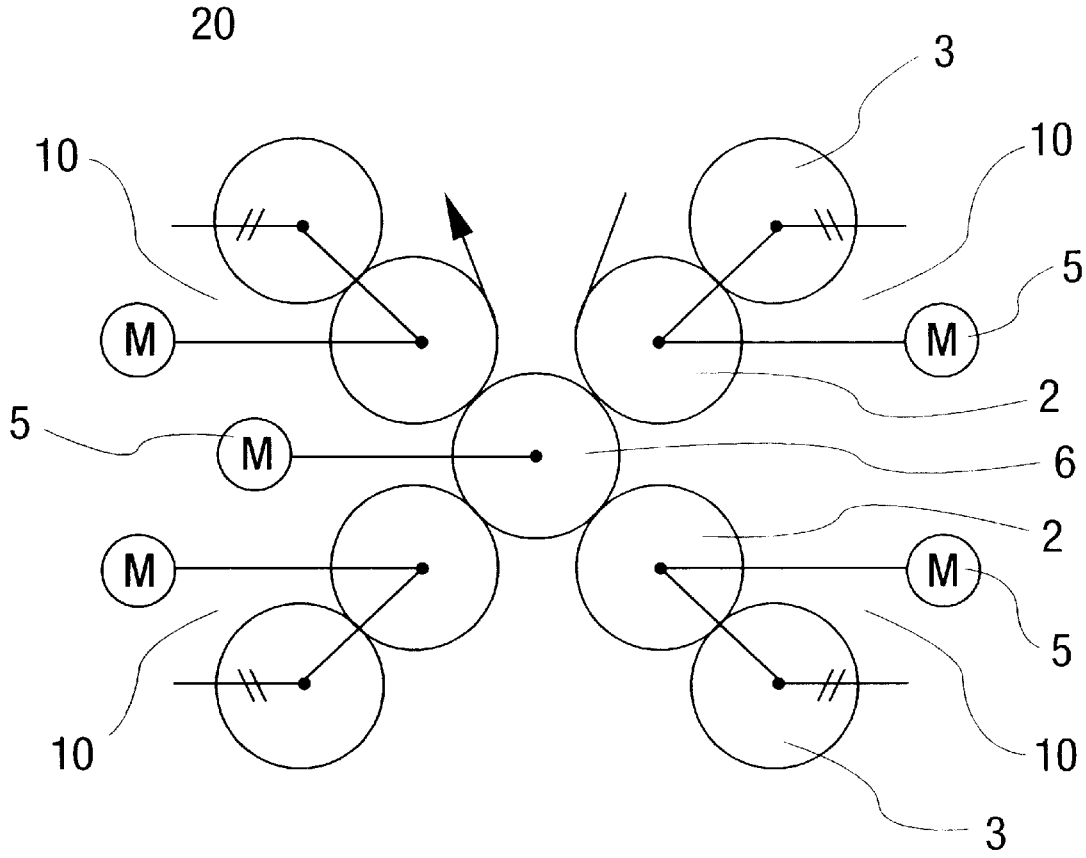
FIG. 3 is a schematic view showing a cylinder unit with an individually driven central cylinder and four cylinder groups according to the invention.

FIG. 3 shows a cylinder unit 20 comprised of a central steel cylinder 6 and four cylinder groups 10 associated with that central cylinder 6. One blanket cylinder 2 and one plate cylinder 3 each are integrated into one cylinder group 10 in this exemplary embodiment. A separate three-phase motor 5 is provided for driving the central cylinder 6. However, the central cylinder 6 could also form a cylinder group corresponding to the variant shown in FIG. 2 with one of the four cylinder groups 10. The separate motor 5 for the central cylinder 6 would be eliminated as a result. However, on the other hand, the integration (shown in FIG. 3) into the smallest possible cylinder groups 10 and the individually driven central cylinder 6 into a cylinder unit 20 offers the highest possible flexibility in terms of the possibilities of configuration. This configuration of a cylinder unit 20, derived from the above-described basic variants, offers the printing technical advantage that the so-called fan-out effect remains within very narrow limits. Furthermore, each of the blanket cylinders 2 can be reversed to blanket/blanket production in a simple manner. The possibilities of reversing to various types of alternate printing are not limited, either.

As this exemplary embodiment shows, a cylinder group 10 formed from cylinder pairs is equivalent in terms of the possibility of configuration, to a design with individually driven cylinders.

Figure 4:
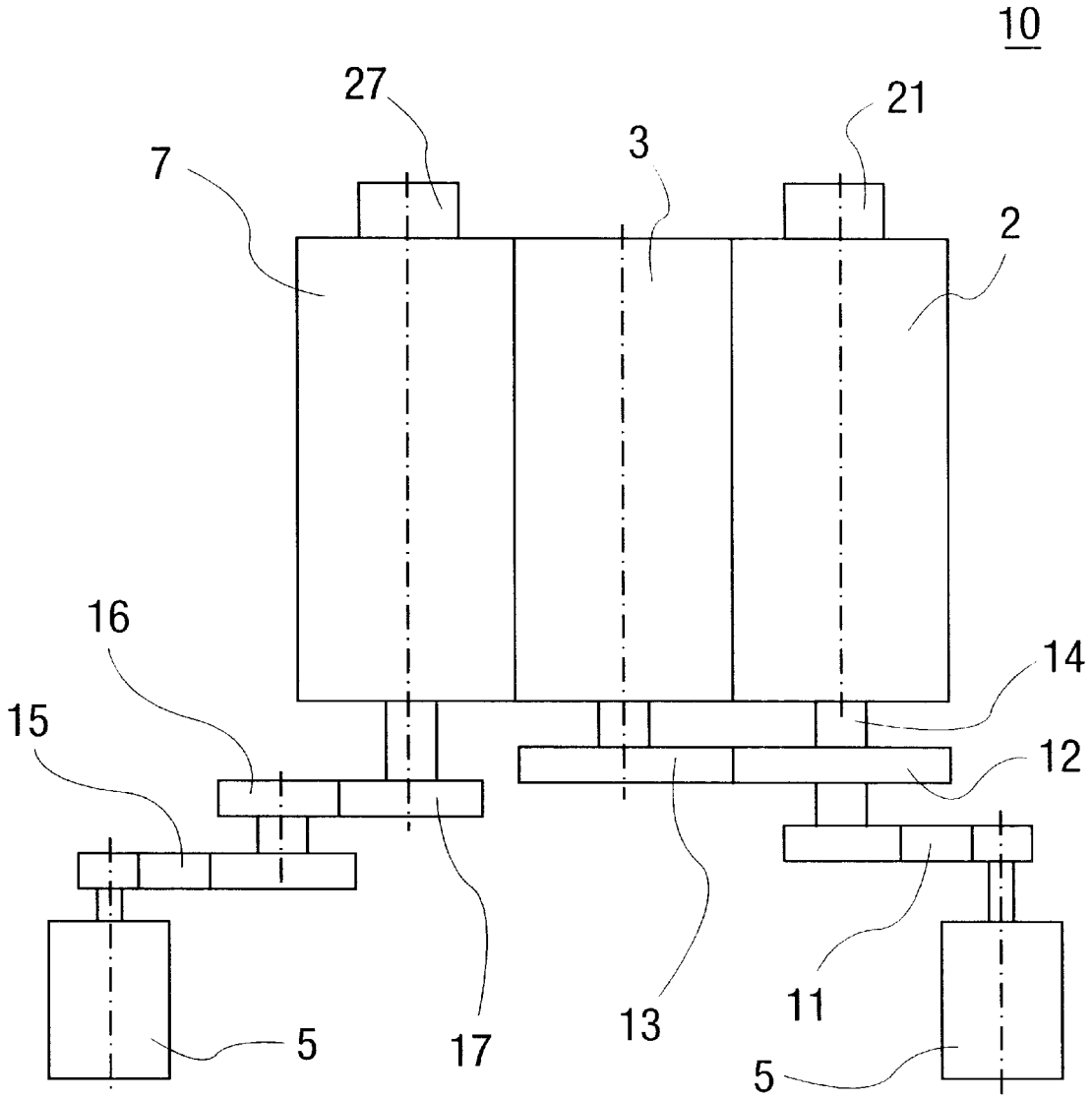
FIG. 4 is a top view of a cylinder group with an associated, individually driven inking roller according to the invention.

FIG. 4 shows the cooperation of a cylinder group 10 comprised of a blanket cylinder-plate cylinder pair 2, 3 with an inking roller 7. The inking roller 7 has a separate drive by a motor 5 here, which may, but does not need to, be identical with the motor 5 for the cylinder group 10. The motor 5 for the inking roller 7 drives the inking roller 7 via a toothed belt 15 and a gear pair 16, 17, wherein the gear 17 is mounted on the shaft of the inking roller 7. The different mass inertias of the motor 5 and of the inking roller 7 are kept under control by properly selecting the transmission ratio for the drive via the toothed belt 15 and the gear pair 16, 17.

The circumferential velocity of the inking roller 7 is adjustable with a slight negative slip in relation to the plate cylinder 3. As a result, it is possible to counteract the risk that the mechanical coupling formed by a gear pair 12, 13 between the blanket cylinder 2 and the plate cylinder 3 will be disengaged.

The cylinder group 10 is driven by a motor 5 via the toothed belt 11 on the blanket cylinder 2. The mechanical coupling between the blanket cylinder 2 and the plate cylinder 3 of the same cylinder group 10 is formed by the two gears 12 and 13. To keep a high mass inertia ratio of the load to the drive, namely, the cylinder group 10 and the motor 5, under control, the speed of rotation of the motor 5 is correspondingly reduced via the toothed belt 11. This toothed belt 11 is the elastic coupling member between the motor 5 and the driven cylinder group 10. Very high damping of the motor/load system 5, 10 is achieved with the toothed belt 11 compared with a direct coupling or a gear coupling, which is also possible, in principle. The same is also true, in principle, of the drive of the inking roller 7 and its coupling member, the toothed belt 15. Furthermore, a great freedom is created for design due to the selection of a toothed belt because of the infinitely variable transmission. The motors 5 for the cylinder group 10 and the inking roller 7 are three-phase motors with high field rigidity. The modular principle of forming cylinder groups and roller groups with toothed belt coupling to the drive motor is applied here as well, because the entire range of variation of cylinder and roller lengths and diameters can be provided with correspondingly different mass inertias with a few motor output classes.

The two gears 12 and 13, which form the mechanical coupling between the blanket cylinder 2 and the plate cylinder 3, may be helical gears or spur gears. In the case of helical gears, the blanket cylinder 2 is displaced longitudinally during the lateral register adjustment, while the gear 12 and the corresponding gear for the toothed belt 11 remain stationary, i.e., these two gears are mounted longitudinally displaceably on the cylinder shaft 14. If the two gears 12 and 13 are spur gears, the gear 12 and the gear for the toothed belt 11 are rigidly mounted on the shaft 14, and they are longitudinally displaced together with the blanket cylinder 2 and with the motor 5 for the cylinder group 10.

In contrast to the controls known from the construction of rotary printing machines, the motor/load system 5, 10 is controlled by an actual value that is generated by a mechanical load transducer 21 arranged on the load side, namely, at the torque-free end of the shaft 14 of the blanket cylinder 2. The same type of control, namely, with a load transducer 27 arranged at the load-free shaft end of the inking roller 7, is selected for controlling the speed of rotation of this inking roller 7.

Figure 5:
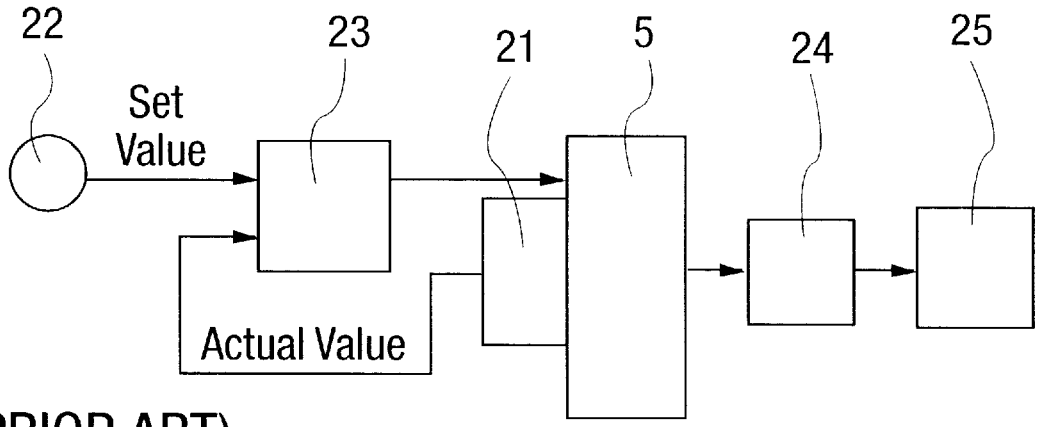
(PRIOR ART) Fig. 5
FIG. 5 is a diagram showing the control of the drive for a cylinder group corresponding to the state of the art.

A control known in the construction of printing machines is schematically represented in FIG. 5. The motor 5, which drives a load 25 via an elastic coupling 24, is driven by means of a regulator 23. The load 25 is a heavy roller or a heavy cylinder or a corresponding roller or cylinder system, whose mass inertia is typically more than 5 times that of the motor 5. Yet, the control of this motor/load system must be optimized for the output, and the speed of rotation or the angular position and the speed of rotation of the load 25 must be controlled with sufficiently high performance. High requirements should not be imposed on the coupling 24 of the motor and the load because of its torsional rigidity and its absence of clearance.

In the prior-art systems, as shown in FIG. 5, a mechanical actual value transducer 21 is arranged on the motor 5 for generating an electrical signal characteristic of the position or the speed of rotation and the position of the rotor of the motor 5. The load 25 is fastened to the motor shaft end with a coupling 24, which has an elasticity and possibly a certain clearance. The coupling and the load are located outside the actual control loop. However, they can influence it via the acceleration torques acting on the motor shaft.

This system rapidly reaches its dynamic limits at high mass inertia ratios of the load to the motor. If the control becomes unstable, especially the motor will vibrate, while the load will remain relatively still.

Figure 6:
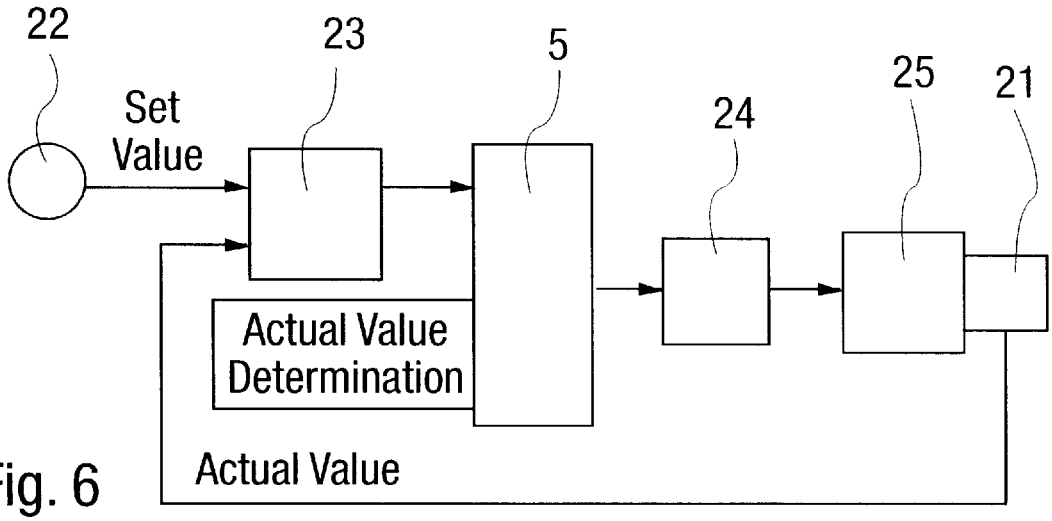
FIG. 6 is a diagram showing the control for the drive of a cylinder group according to the present invention.

In contrast, FIG. 6 shows a control in which, as was already shown in FIG. 4, the reference variable for the control is generated by a transducer 21, which is arranged on the load 25 rather than on the motor 5. This actual value transducer 21 is arranged at the free shaft end of the load, namely, at the free shaft end of the blanket cylinder 2 of a cylinder group 10 in this exemplary embodiment. This actual value transducer 21 will therefore hereinafter be called a load transducer. The coupling 24 is formed by the above-described toothed belt 11 with high elasticity but also high damping compared with a direct coupling or a gear coupling. In addition, this coupling 24 with a toothed belt is free from clearance.

The actual value needed for the control, which is generated by the load transducer 21 and represents the angular position of the blanket cylinder 2 or its speed of rotation and its angular position, is fed back to the regulator 23. A computer-generated set value from the set value transducer 22 is compared with this actual value and is used to form a control signal for the motor 5.

The coupling 24 and the load 25 are within the actual control loop in this control. The load and the coupling 24 form a low-pass filter for the impacts and vibrations generated in the control system, which are consequently returned into the regulator 23 to a reduced extent only, and therefore they cannot lead to undesired excitations of the control, either. The dynamics and also the control performance are considerably improved as a result compared with the prior-art systems even with an otherwise identical coupling. The system, comprised of a regulator, a motor, a coupling, and a cylinder, is already inherently damped substantially more strongly. Therefore, resonance step-ups do not occur to the same extent. The regulator can therefore be adjusted more rapidly without leaving the stable operating range.

An actual value determination means 40, which is shown in the exemplary embodiment according to FIG. 6 and may possibly be arranged on the motor 5, may be used for an additional monitoring of the motor 5, e.g., if the possibility of an emergency shut-off of the motor 5 is desired.

Figure 7:
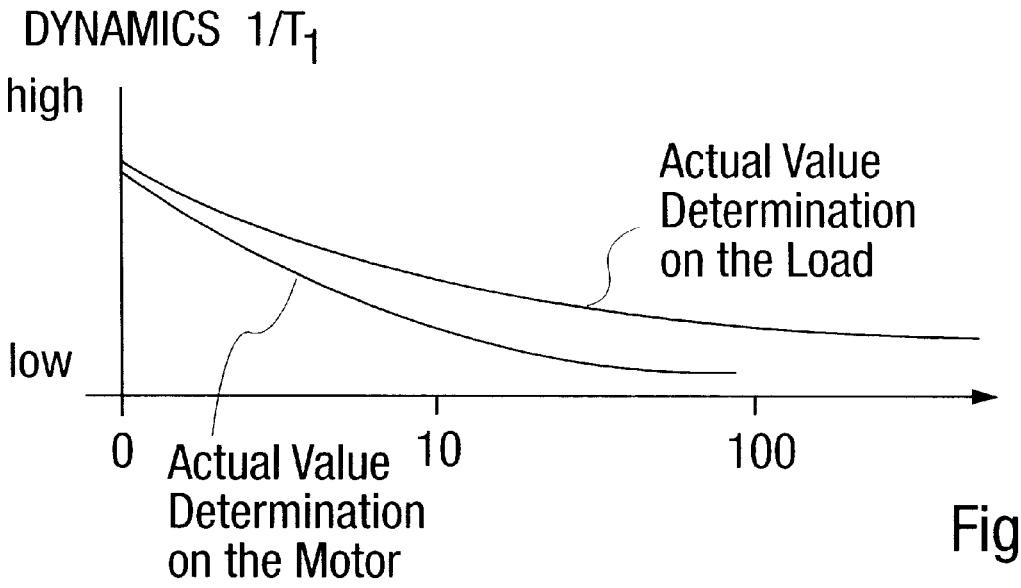
FIG. 7 is a graph showing a comparison of the dynamic behavior of a prior-art control and of a control according to the present invention as a function of the mass inertia ratio of the motor to the load.
Figure 8:
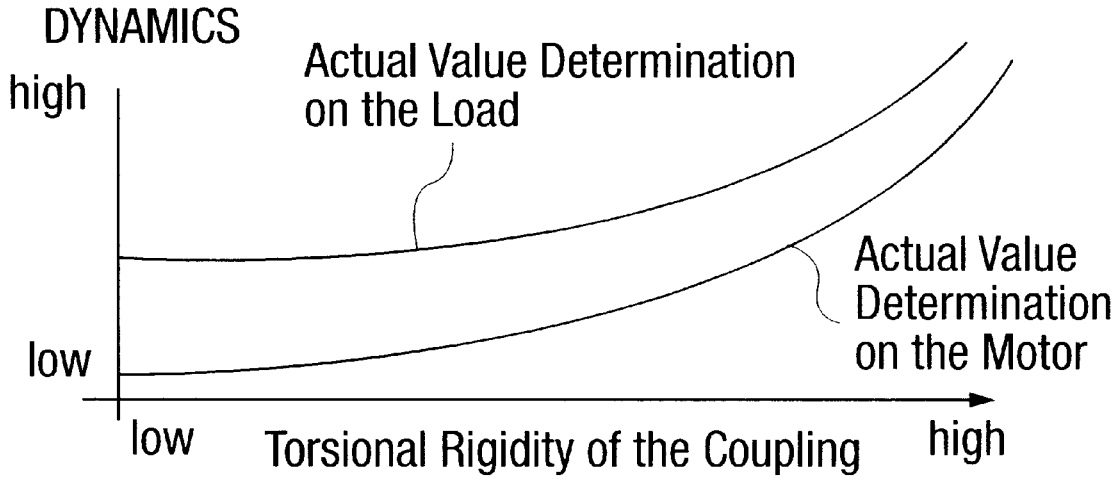
FIG. 8 is a graph showing a comparison of the dynamic behavior of a prior-art control and of a control according to the present invention as a function of the torsional rigidity of the coupling between the motor and the load.

The dynamic behaviors of the two controls according to FIGS. 5 and 6 are compared in the diagrams in FIGS. 7 and 8. The reciprocal value of the reset time $T_i$ of the drive is selected as the criterion of the dynamics of the control. FIG. 7 shows the dynamics as a function of the mass inertia ratio of the load to the motor with identical coupling and identical phase reserve. It is clearly seen that the control according to FIG. 6, with actual value determination at the load, is markedly superior to the actual value determination at the motor corresponding to FIG. 5 precisely at higher mass inertia ratios.

FIG. 8 shows the dynamics as a function of the torsional rigidity of the coupling 24 at constant mass inertia ratio and identical phase reserve. The control according to FIG. 6 is seen to be superior to the prior-art control according to FIG. 5 especially at a low torsional rigidity of the coupling.

Figure 9:
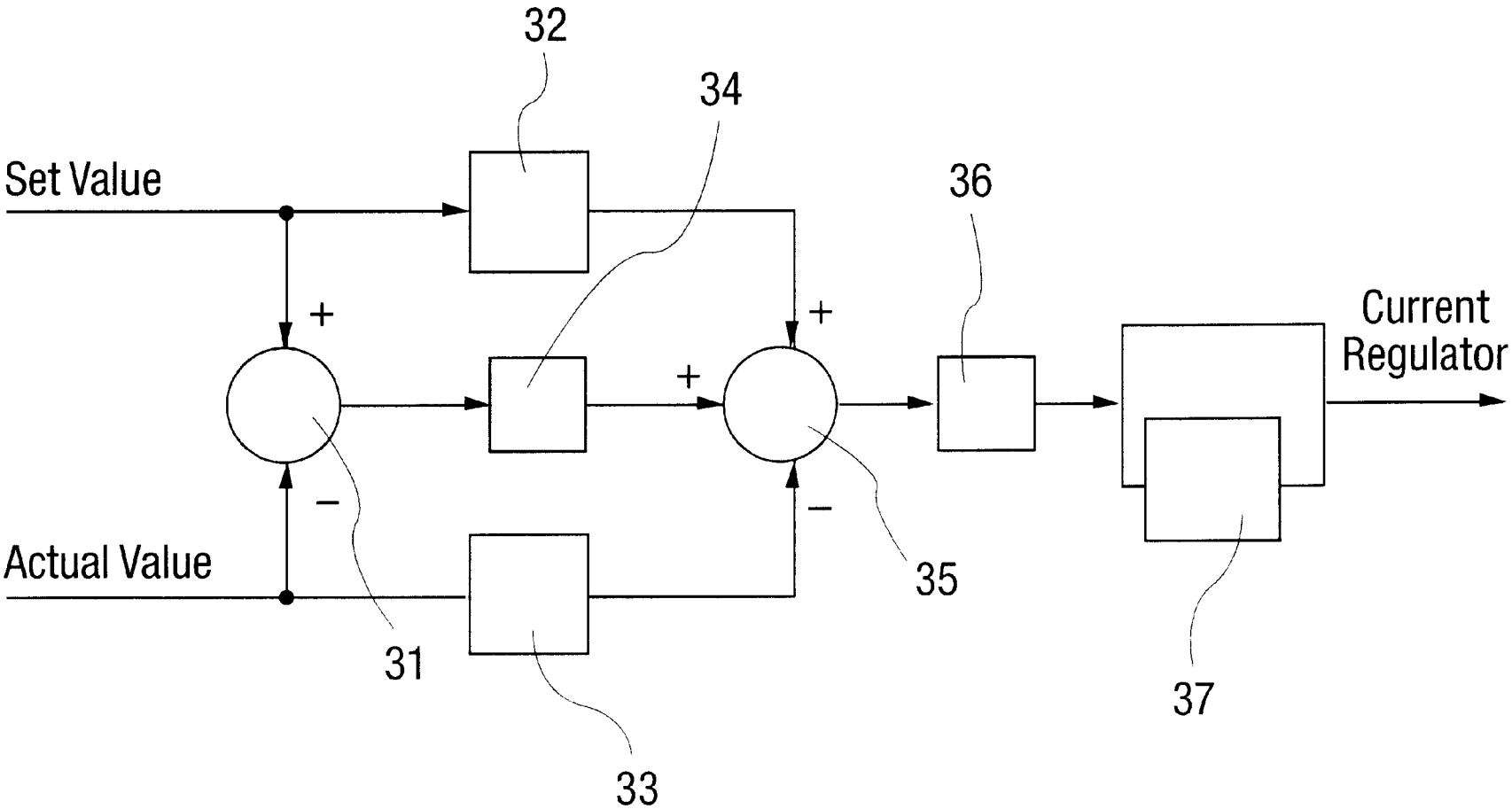
FIG. 9 is a control diagram of the regulator, according to the invention.

Finally, FIG. 9 shows the control diagram of the regulator 23. The set value and the actual value, the desired position and the actual position of a blanket cylinder 2 in the exemplary embodiment, are sent to a first differential amplifier 31 to form the difference between the set value and the actual value. The difference $D_l$ formed there is sent to a first proportional amplifier 34 and is then sent as a proportionally amplified signal $K_l XD_l$ to a second differential amplifier 35. At the same time, the set value and the actual value are sent to a differential element 32 and 33, respectively, differentiated, and the corresponding output signals $S_?$ and $S_i$ are sent to the second differential amplifier 35. The sum $k_l D_l + S_? - S_i$ formed there is amplified in a second proportional amplifier 36 and sent to a current regulator for the motor 5 via an integrating circuit 37.

Figure 10:
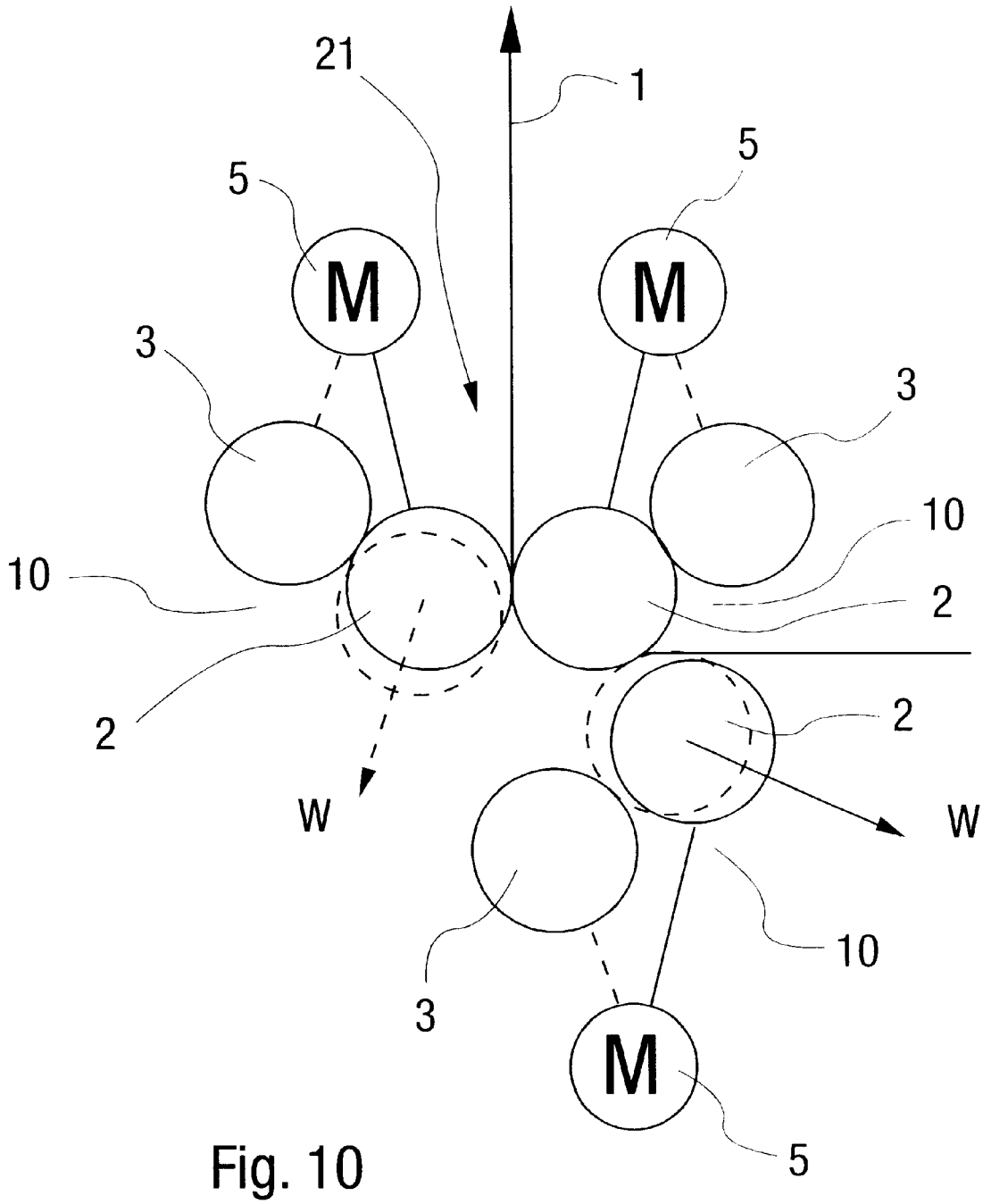
FIG. 10 is a schematic view showing a print position formed by three cylinder groups in the Y position.

FIG. 10 shows a print position which is formed by three cylinder groups 10. A first cylinder group 10 is arranged on one printed side of the web of paper 1, and second and third cylinder groups 10 are arranged on the opposite printed side of that web of paper 1. The two cylinder groups 10 arranged on the same printed side of the web of paper 1 can be alternatingly engaged with the blanket cylinder 2 of the first cylinder group 10. This is indicated by two straight arrows W. The two upper cylinder groups 10, which are located approximately horizontally opposite each other, are integrated into a cylinder unit 20 and are mounted as such in the machine frame independently from the lower cylinder group 10. Each cylinder group 10 is driven individually by a motor 5, as in the case of the two cylinder groups 10 according to FIG. 1.

This arrangement makes possible a flying change-over of production with continuous movement of the web of paper 1. One of the two blanket cylinders 2 that can be pivoted down is pivoted down, while the other is in the printing position with the opposite blanket cylinder 2 of the first cylinder group 10. The production is changed over in the known manner by changing the plates of the plate cylinder 3 associated with the blanket cylinder 2 pivoted down.

Figure 11:
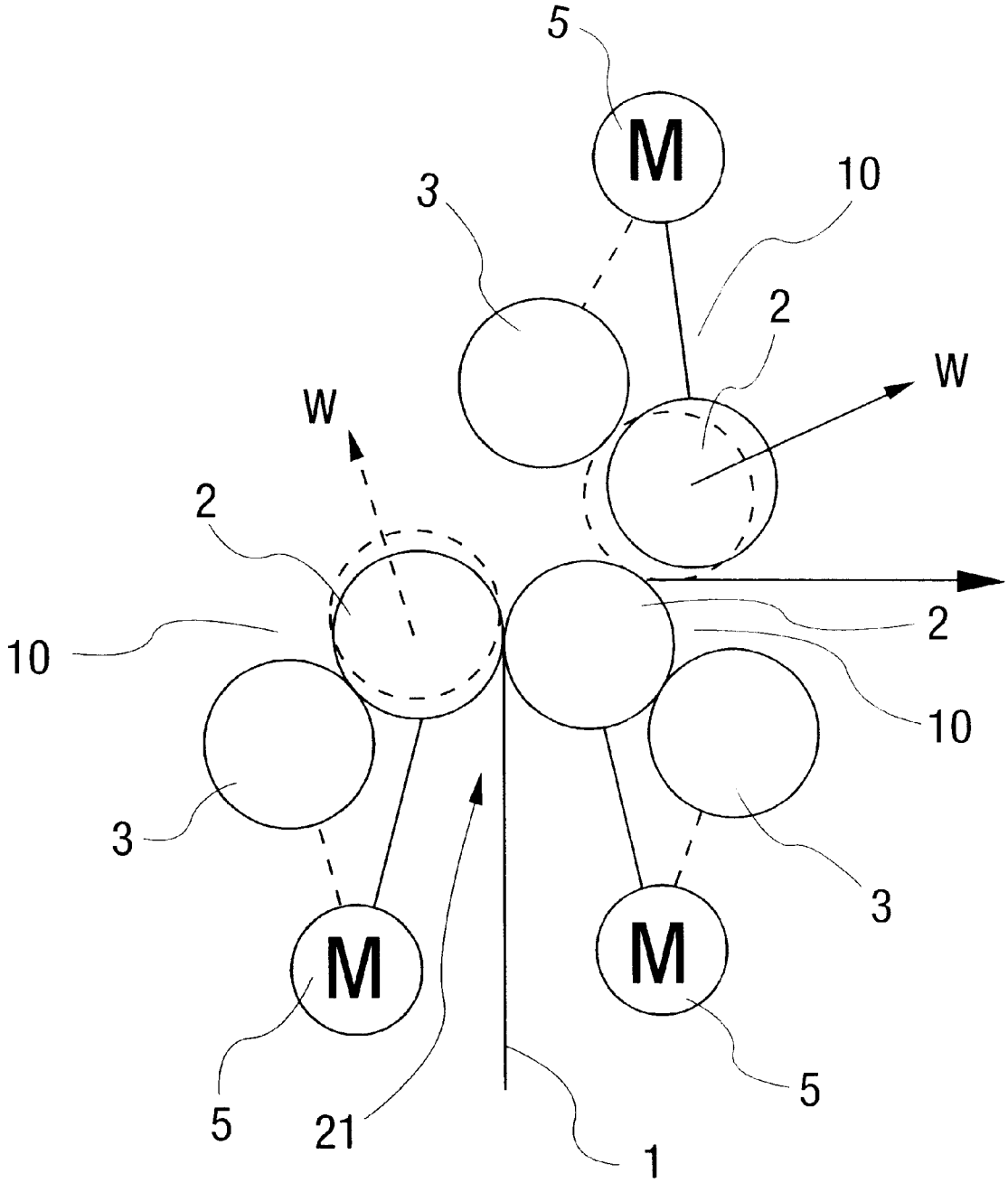
FIG. 11 a schematic view showing a print position formed by three cylinder groups in the lambda position.

FIG. 11 shows an alternative print position, likewise with three cylinder groups 10. What was stated in connection with the arrangement according to FIG. 10 also applies, in principle, to the arrangement according to FIG. 11. While the three cylinder groups 10 of the arrangement according to FIG. 10 form the legs of a "Y,", the cylinder groups 10 according to FIG. 11 form an inverted "Y" or a "lambda." In the arrangement according to FIG. 11, the two lower cylinder groups 10, located horizontally opposite each other, are mounted in the machine frame independently from the upper cylinder group 10. As a result, these two lower cylinder groups 10 form the assembly unit or cylinder unit 20.

The arrangements according to FIGS. 10 and 11 show the high flexibility of the formation according to the present invention of cylinder groups and of the control of each cylinder group according to the present invention. A great variety of print positions can be formed in a particularly simple manner by arranging, e.g., cylinder units 21 with cylinder groups 10 (FIGS. 10 and 11) or a plurality of cylinder units 21 one on top of another (FIG. 1). The cylinders of the arrangements according to FIGS. 10 and 11 may, in principle, also be coupled in a manner different from the coupling according to FIGS. 1 through 4, e.g., via a single gear mechanism.

While specific embodiments of the invention have been shown and described in detail to illustrate the application of the principles of the invention, it will be understood that the invention may be embodied otherwise without departing from such principles.

What is claimed is:

1. A rotary printing press comprising:

a plurality of blanket cylinders forming a plurality of print positions, each of said plurality of blanket cylinders forming one of said plurality of print positions with another of said blanket cylinders;

a plurality of plate cylinders, each of said plate cylinders being combined with one of said plurality of blanket cylinders to form a plurality of cylinder pairs;

a plurality of drives, each of said plurality of drives separately driving one of said plurality of cylinder pairs, said each drive including a motor and a toothed belt driving a respective said blanket cylinder from said motor, said each drive also including a mechanical coupling drivingly connecting a respective said blanket cylinder to a respective said plate cylinder, each said plate cylinder being driven through a respective said mechanical coupling from power taken off from a respective said blanket cylinder.

2. The press in accordance with claim 1, further comprising:

an inking system with an inking roller associated with each of said cylinder pairs, said inking roller being one of mechanically coupled with a respective said cylinder pair and a separate ink drive.

3. The press in accordance with claim 2, wherein:

said ink drive includes an ink motor and a toothed belt connecting said ink motor to said inking roller.

4. The press in accordance with claim 1, further comprising:

control means for controlling one of a speed and a position of said cylinders, said control means including a set value transducer for providing a desired value of said one of speed and position for said cylinders, said control means also including an actual value transducer for measuring an actual value of said one of speed and position of said cylinders, said control means also includes a regulator for adjusting operation of said motor dependent on a difference between said desired value and said measured actual value.

5. The press in accordance with claim 4, wherein:

said measured actual value sent by said actual value transducer forms a principal control variable for said regulator.

6. The press in accordance with claim 4, wherein:

said control means operates without input from a mechanical actual value transducer determining one of position and speed of rotation of said motor.

7. The press in accordance with claim 4, further comprising:

a mechanical transmitter on one of said motors and generating an output signal used for an emergency shut down of said one motor.

8. The press in accordance with claim 4, wherein:

one of said blanket cylinders of said cylinder pairs has a torque-free shaft end not directly driven by said motor, said actual value transducer is arranged on said torque-free shaft end.

9. The press in accordance with claim 1, wherein:

one of said cylinder pairs is on a first printing side, two of said cylinder pairs are on a second printing side.

10. The press in accordance with claim 9, wherein:

a blanket cylinder of said one cylinder pair forms a counter pressure cylinder for said two cylinder pairs, each one of said two cylinder pairs being usable alternately.

11. The press in accordance with claim 1, wherein:

two of said cylinder pairs are arranged horizontally opposite each other and are combined to form a cylinder unit, said two cylinder pairs are mounted in a machine frame independently of a third of said cylinder pairs.

12. The press in accordance with claim 11, wherein:

said cylinder unit is arranged in one of a Y-shape and an A-shape with said third cylinder pair.

13. The press in accordance with claim 1, wherein:

said toothed belt forms a coupling between respective said blanket cylinders and said motors which is substantially clearance free, elastic and forms a high damping coupling between respective said blanket cylinders and motors, said toothed belt of said respective drives forms a low-pass filter between said respective motor and blanket cylinder, said drive means each includes an infinitely variable transmission in combination with respective said toothed belts.

14. The press in accordance with claim 1, wherein:

each said print position forms a passage for a web between two respective said blanket cylinders forming said each print position, said two blanket cylinders which form a respective said print position perform printing on opposite sides of the web.

15. The press in accordance with claim 1, wherein:

said mechanical coupling forms a direct driving of a respective said blanket cylinder by a respective said motor.

16. The press in accordance with claim 1, wherein:

one of said blanket cylinders forms more than one of said print positions with other said blanket cylinders.

17. The press in accordance with claim 14, wherein:

one of said blanket cylinders forms more than one of said print positions with other said blanket cylinders.

18. The press in accordance with claim 14, wherein:

one of said print positions is formed by a first set of said plurality of blanket cylinders and another of said print positions are formed by a second set of said plurality of blanket cylinders, said first and second set of blanket rollers being mutually exclusive.

19. The press in accordance with claim 1, further comprising:

a control device for adjusting a circumferential register of one said blanket cylinders with another of said blanket cylinders.

20. Rotary printing machine comprising:

a blanket cylinder;

a plate cylinder;

mechanical coupling means for mechanically coupling together said plate cylinder and said blanket cylinder in a manner to be commonly driven, said mechanical coupling means and said blanket and plate cylinders having a load mass moment of inertia;

drive means including a drive motor with a toothed belt for directly driving one end of one of said blanket cylinder and said plate cylinder, the other of said blanket and plate cylinder being correspondingly driven by said mechanical coupling means, said drive means having a drive mass moment of inertia, said load mass moment of inertia being larger than said drive moment mass of inertia, said toothed belt forming a low pass filter between said drive mass moment of inertia and said load mass moment of inertia;

control means for controlling one of a speed and a position of said cylinders, said control means including set value transducer means for providing a desired value of said one of speed and position for said cylinders, said control means also including an actual value transducer means for measuring an actual value of said one of speed and position of said cylinders, said control means also includes a regulator for adjusting operation of said motor dependent on a difference between said desired value and said measured actual value, said actual value transducer being arranged on another end of said one of said blanket and plate cylinder.

21. The press in accordance with claim 20, wherein:

said control means adjusts a circumferential register of one said blanket cylinders with another of said blanket cylinders.

22. Rotary printing machine comprising:

a first blanket cylinder;

a first plate cylinder;

first mechanical coupling means for mechanically coupling together said first plate cylinder and said first blanket cylinder in a manner to be commonly driven;

first blanket drive means including a drive motor and a toothed belt for directly driving said first blanket cylinder, said first plate cylinder being correspondingly driven by said first mechanical coupling means;

a second blanket cylinder;

a second plate cylinder;

second mechanical coupling means for mechanically coupling together said second plate cylinder and said second blanket cylinder in a manner to be commonly driven;

second blanket drive means including a drive motor and a toothed belt for directly driving said second blanket cylinder, said second plate cylinder being correspondingly driven by said second mechanical coupling means, said second drive means separately driving said second blanket cylinder from driving of said first blanket cylinder;

a counterpressure cylinder positioned adjacent said first and second blanket cylinders, said blanket cylinders and said counterpressure cylinder forming first and second print positions between themselves for passing a web between said counterpressure cylinder and said first and second blanket cylinders at said first and second print positions, said counterpressure cylinder being mechanically drivably isolated from said first and second drive means;

counter pressure drive means including a motor for separately driving said counterpressure cylinder from driving of said first and second blanket cylinders.

* * * * *